US007712258B2

(12) United States Patent
Ewing et al.

(10) Patent No.: US 7,712,258 B2
(45) Date of Patent: May 11, 2010

(54) SUSPENSION AND SILL SYSTEM FOR SLIDING MEMBERS

(75) Inventors: K. Bradley Ewing, Suite 2, 270 East Keith Road, North Vancouver, British Columbia (CA) V7L 1V5; Brent John Ewing, North Vancouver (CA); Bruce Hewson, West Vancouver (CA)

(73) Assignee: K. Bradley Ewing, North Vancouver, British Columbia (CA)

( * ) Notice: Subject to any disclaimer, the term of this patent is extended or adjusted under 35 U.S.C. 154(b) by 0 days.

(21) Appl. No.: 10/830,893

(22) Filed: Apr. 22, 2004

(65) Prior Publication Data

US 2005/0235571 A1 Oct. 27, 2005

(51) Int. Cl.
*E05D 13/00* (2006.01)

(52) U.S. Cl. ..... 49/410; 49/409; 49/425; 49/417; 16/97; 16/105

(58) Field of Classification Search ..... 49/409, 49/410, 425, 417; 16/97, 98, 99, 102, 105; 160/196.1

See application file for complete search history.

(56) References Cited

U.S. PATENT DOCUMENTS 524,609 A * 8/1894 Prouty ..... 16/105
627,991 A * 7/1899 Ensign ..... 16/105
844,468 A * 2/1907 Prouty ..... 16/105
1,042,927 A * 10/1912 King ..... 16/105
2,856,040 A 10/1958 Dansereau
3,384,998 A 5/1968 Abramson
4,228,560 A 10/1980 Baus
4,891,921 A 1/1990 Governale
5,584,142 A 12/1996 Spiess
6,122,868 A * 9/2000 Knezevich ..... 52/202

FOREIGN PATENT DOCUMENTS

EP 0904721 3/1999
JP 2002168035 6/2002

* cited by examiner

*Primary Examiner*—Jerry Redman
(74) *Attorney, Agent, or Firm*—John Russell Uren

(57) ABSTRACT

A panel or door suspension system used to hang sliding panels or doors. The panel members are hung by an upper bearing assembly with bearings on each side of the longitudinal axis of the panel thereby allowing the weight of the door to bear wholly on the upper bearings and to act centrally and downwardly between the bearings thereby preventing a moment on the bearings. A wedge member attached to the upper portion of the panel allows for vertical adjustment of the panel relative to the bearings and the door frame. A sill assembly beneath the panel allows for stable sliding operation of the panel member, provides for debris drainage and facilitates servicing of the members comprising the sill assembly.

8 Claims, 2 Drawing Sheets

SUSPENSION AND SILL SYSTEM FOR SLIDING MEMBERS

INTRODUCTION

This invention relates to a suspension and sill system for sliding members and, more particularly, to a suspension and sill assembly system for heavy duty sliding doors or panels which doors or panels may be exposed to exterior weather conditions.

BACKGROUND OF THE INVENTION

Exterior sliding doors or panels which are opened and closed by sliding within a groove and which are maintained in their generally vertical position during the sliding movement are ubiquitous in residential and commercial construction. However, disadvantages in the use and installation of such panels are well known. First, if the sliding members are heavy, hanging such members is difficult and two or more specialized installers may be required. Second, continued and proper adjustment of the sliding panels is important for proper operation of the panels or doors and, again, skilled labor may not be readily available. Third, existing sliding members generally have their entire weight acting on bearings located on the bottom of the door which run on a rail. The rail is raised from the surface of the exterior and interior floors which causes access problems for carts and disabled users. The bearings, being on the bottom of the door, attract water and other debris which contacts the door and falls downwardly into the bearing area over time. The debris may enter the bearings, prohibit smooth movement of the doors and cause premature wear. In an effort to prevent this contamination, friction brushes are often used which, in turn, interfere with the smooth movement of the sliding members. Fourth, the weight of such doors may act in an unbalanced way on the bearings if they are not precisely positioned. Thus, one set of bearings may receive more loading than a second set of bearings which affects the operation of the doors and the bearing life. Finally, subsequent service to the sliding members after installation typically requires a number of service personal to raise the doors off their track for cleaning, item replacement and the like. Thereafter, the panel members will require installation and adjustment. This is unnecessarily expensive, time consuming and inconvenient for the user.

SUMMARY OF THE INVENTION

According to one aspect of the invention, there is provided a suspension system for a sliding panel assembly which panel assembly comprises at least one vertically positioned sliding panel, said suspension system comprising a bearing assembly for said panel operable to be connected to the upper frame of said panel and a bottom guide for said panel operable to be connected to the bottom of said panel, said bearing assembly including at least one pair of bearings, each of said bearings being operable to move in a track and a hanger operably connected between said one pair of bearings, said panel being hung from said hanger such that the weight of said panel acts principally through said hanger and applies equal loading to each of said bearings.

According to a further aspect of the invention, there is provided a method of installing a sliding panel within a frame for said panel and within an upper bracket at the top of said panel and a guide on the bottom of said door, said method comprising installing a bearing assembly to carry substantially all of the weight of said panel in said upper bracket, moving one of said wedge assembly or said bearing assembly relative to the other of said wedge assembly or bearing assembly to raise or lower said panel relative to said upper bracket and relative to said frame of said door.

According to yet a further aspect of the invention, there is provided a sliding panel for installation within an upper bracket of a panel frame and a lower drain tube of said frame, said sliding panel comprising an upper bearing assembly operably connected to the top of said panel and movable within said upper bracket and a lower guide member on the bottom of said panel which guide member is movable within said lower drain tube, said upper bearing assembly comprising at least two rotatable bearings movable on respective guide paths located on opposite sides of and within said upper bracket and a hanger extending downwardly from and between said two bearings, said panel having a weight which acts principally downwardly through said hanger and exerting substantially identical forces on each of said bearings on opposite sides of said hanger.

According to still yet a further aspect of the invention, there is provided a sill construction for sliding members which sliding members include bearings operably mounted on the top of at least one of said sliding members to accommodate sliding movement of said member and a guide operably mounted to the bottom of said one of said sliding members, said guide being movable within a guide box and acting to stabilize said member during said sliding movement.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
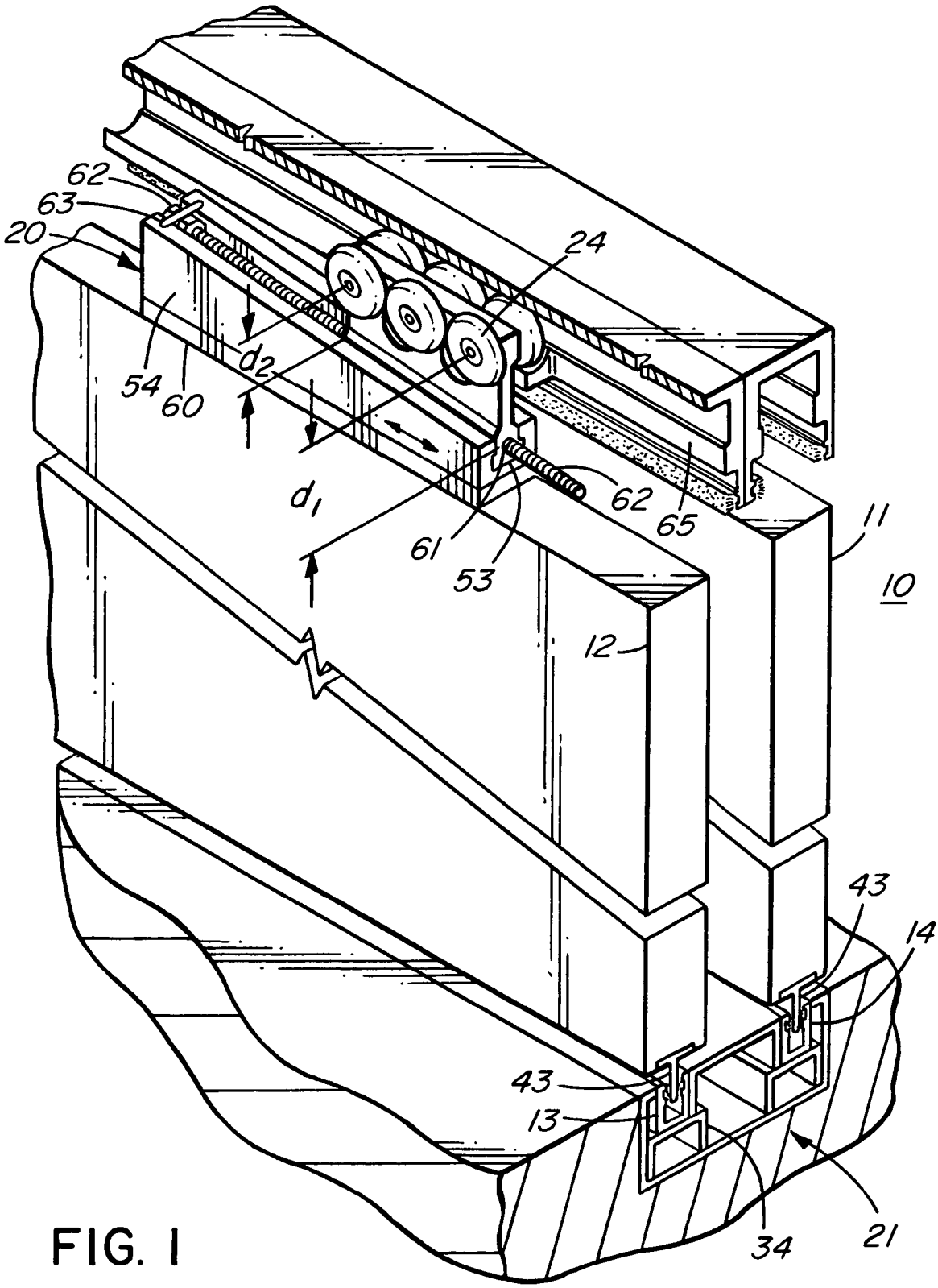
FIG. 1 is a diagrammatic isometric and cutaway view of two(2) adjacent sliding doors moving within adjacent drain tubes and which sliding doors incorporate the teachings of the present invention.
Figure 2:
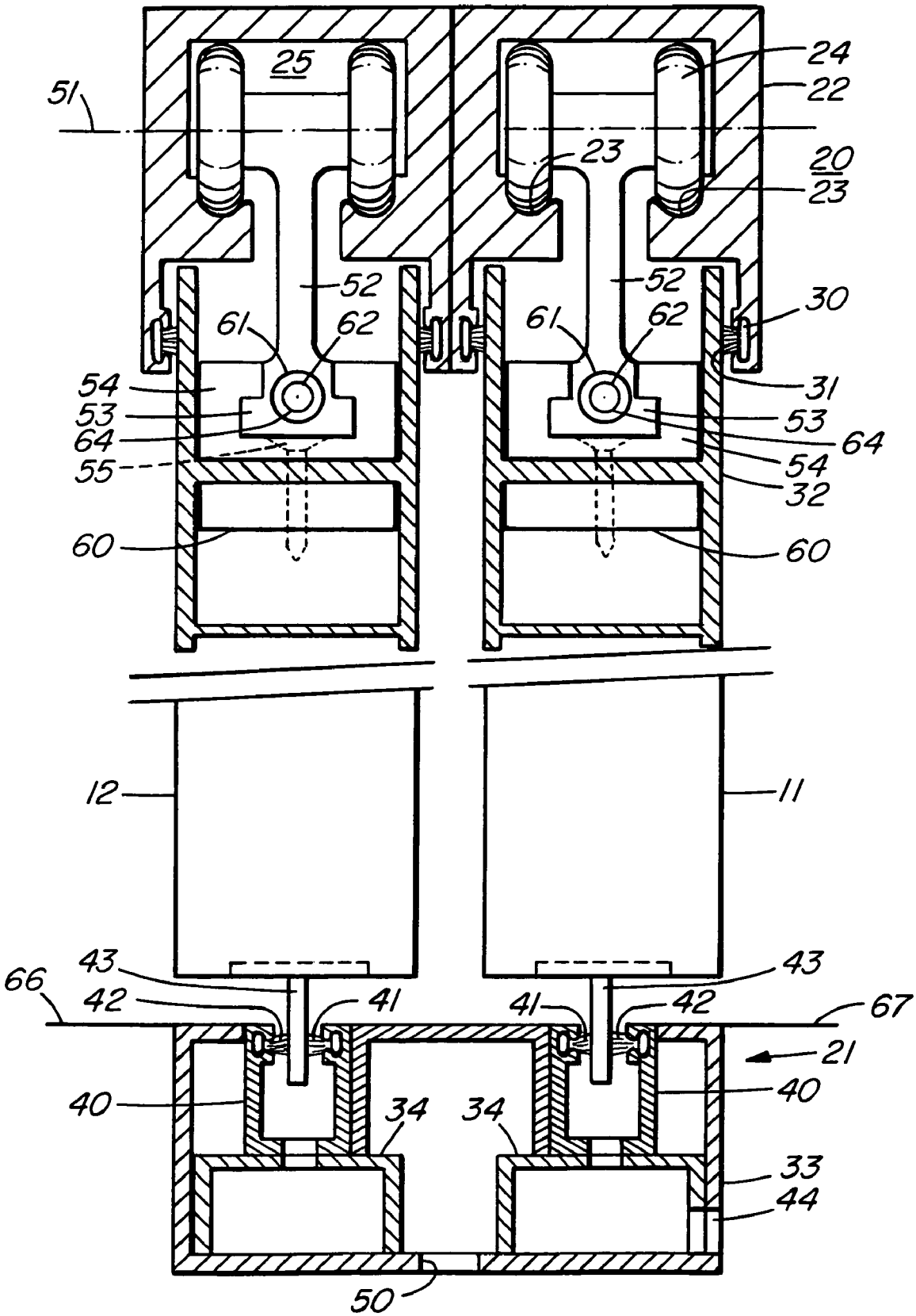
FIG. 2 is a diagrammatic end view of the sliding doors particularly showing the bearing mounting and the sill construction in which the sliding doors are guided according to a further aspect of the invention.

Referring now to the drawings, a set of sliding doors, in this case, two(2) such doors 11, 12 is generally shown at 10 in FIG. 1. The first and second doors 11, 12, respectively, move within respective guide strips 13, 14 and are each hung from a pair of upper hanging assemblies, one such hanging assembly being generally illustrated in detail at 20. A lower guide or sill assembly is generally illustrated at 21 in FIG. 2, it being understood that the upper hanging assemblies 20 and the lower guide or sill assembly 21 are the same for each of the sliding doors 11, 12.

A support bracket conveniently in the form of an aluminum extrusion 22 is mounted in the frame of the house or other structure (not shown). The support bracket 22 includes two(2) bearing guide paths 23 to allow the rotating bearings 24 of the bearing assembly 20 to move therein as will be described. The support bracket 22 also conveniently includes brush housings 30 which hold removable mohair brushes 31 used to provide a brushing action against the top frame member 32 of door 11 and thereby to prevent the ingress of water and debris and to remove loose foreign material from the door 11 during the sliding operation.

A second extrusion, conveniently a plastic drain tube 33, is similarly mounted in the frame of the house or other structure and forms the principal member of the sill assembly 21. The drain tube 33 contains side drain holes 44 and/or bottom drain holes 50 to allow the drainage of moisture and other debris to the outside environment. The drain tube 33 also allows for the entrance and retention of several shims or ribs 34. The shims 34 (FIG. 2) extend perpendicular to the longitudinal axis of the drain tube 33 and are relatively narrow. The shims 34 provide support for the guide strips 40 which are removably mounted on the shims 34 and within the drain tube 33. The guide strips 40 also contain brush housings 41 which allow the entry of removable mohair brushes 42. The brushes 42 bear on a guide or key 43 which is connected to the lower portion of the door 11 and which guide or key 43 provides a degree of stability during the sliding movement of the panel members 11, 12. The guide 43 extends substantially the entire length of the bottom of the door 11 and may take the form of a T-section which is bolted to the bottom of the door 11 at several different locations to ensure connection integrity. It will be noted that the upper surface of the drain tube 33 may conveniently be level with both the interior and exterior floor surfaces 66, 67 thereby allowing carts, wheelchairs and the like to easily move along the floor surfaces 66, 67 and over the top of the drain tube 66 without difficulty although the upper surface may also be raised or lowered relative to the floor surfaces if desired.

The bearing assembly 25 includes the rotatable bearings 24 which are conveniently heavy duty and made from a TEFLON material in order to reduce the friction between the bearings 24 and the bearing guide paths 23 when the bearings 24 are moving within the guide paths 23. The bearings 24 conveniently number three (3) and rotate about respective axes 51. Bearings 24 are connected on each side of a hanger 52 which extends downwardly and centrally between the bearings 24 thereby to reduce or eliminate any moment acting on the bearings 24 by the hanging members 11, 12 which are each connected to the hanger 52 as will be described.

Hanger 52 terminates in an enlarged female member 53 which is mounted for reciprocal and longitudinal movement within a wedge member 54. The hanger 52 extends downwardly from the forward most bearing 24 as viewed in FIG. 1 a distance "d1" which distance "d1" is longer than the distance "d2" from the rearward one of the bearings 24 as also seen in FIG. 1. The slope between the two distances d1, d2 matches the slope of a wedge member 54 in which the female member 53 moves. Wedge member 54 is connected to an anchor plate 60 (FIGS. 1 and 2) which anchor plate 60 is mounted to the top of the door 11 and which has bolts 55 extending there through. Wedge member 54 therefore moves with door 11 and anchor plate 60 and remains stationary relative to the door 11 and anchor plate 60.

A threaded hole 61 extends through the female member 53 of hanger 52 and a threaded bolt 62 is threadedly connected through hole 61. A socket 64 in the end of the threaded bolt 62 allows the entry of a complementary matching member on the end of a tool (not shown) which is used to rotate the bolt 62. The bolt 62 is held by a collar 63 mounted for stationary position within wedge member 54 which collar 63 allows the bolt 62 to rotate freely within the threaded hole 61 of wedge member 54 while not moving the bolt 62 longitudinally and thereby drawing the hanger assembly 25 along the wedge member 54 which, because of the connection between the wedge member 54 and anchor plate 60 to the door 11, allows the panel member or door 11 to be easily moved upwardly and downwardly relative to the door bearing assembly 25 and the support bracket 22 as the installation may require in order that the door 11 hangs cleanly and moves freely.

A recess 65 is provided in the support bracket or aluminum extrusion 22 at the end of the bracket 22 mounted in the frame of the moving panels 11, 12 (FIG. 1). It will be understood that a further and second recess 64 is provided at the opposite end of the support bracket 22 which is not illustrated in FIG. 1. The recess 65 is formed by cutting away material previously forming the bearing guide paths 23 formed on either side of the longitudinal axis of the bracket 22. By removing the guide path material to form the recess 65, the bearing assembly 25 is easily inserted into the support bracket 22 and the bearings 24 can then move freely on the bearing guide paths 23. To prevent the bearings 24 from moving into the recess 65 during sliding movement and operation of the door 11, the wedge member 54 and anchor plate 60 are mounted to the door 11 at a position where, with the door 11 in its limiting positions of movement within lower drain tube 33 and upper support bracket 22, the bearings 24 remain a distance away from the recess 65 thereby avoiding any unnecessary stress in the bearing guide paths 23 adjacent the recess 65 and thereby avoiding the recess 65 entirely.

Operation

In operation, it will be assumed that the upper support bracket 22 and the lower drain tube 33 have been installed in the frame of the structure into which the sliding panel or door assembly 10 is to be installed and that it is now intended to install the panel or door assembly 10 (FIG. 1).

The anchor plates 60, one for each of the bearing assemblies 25, which bearing assemblies 25 are mounted at opposite ends of each panel or door 11, are mounted to the top of each of the doors 11, 12 as seen in FIG. 1 and the key member 43 is attached to the bottom of the doors 11, 12 again by bolting the key member 43 to the door 11. The wedge members 54 are then connected to the anchor plates 60 by bolts 71 extending into the anchor plates 60. One wedge member 54 is mounted to each of the anchor plates 60; that is, one anchor plate 60 and one wedge member 54 are mounted to each end of each door 11, 12.

The lower guide strips 40 will be placed into position within drain tube 33 and will rest on the shims 34, the shims 34 being placed perpendicular to the longitudinal axis of the drain tube 33 and spaced intermittently along its length.

The doors 11, 12 will then be manually moved into their general installation position by placing the key 43 on the bottom of the door 11 into the guide strip 40 and allowing the door 11 to remain substantially vertically in its resting position on the drain tube 33. The top of the door 11 will be inserted into and retained by the sides of the support bracket 22 to prevent the door 11 from moving sidewardly and falling from its temporary and upright position.

An installer will then begin the final hanging. The installer will insert a bearing assembly 25 into each of the wedge assemblies 54 by inserting the rotating bearings 24 into the guide paths 23 through the recess 64 (FIG. 1). He will then move the door 11 until the hanger 52 and male member 53 are aligned with the recess 72 in the wedge member 54 (FIG. 3A) and the bolt 62 is rotated with the installation tool (not shown) which rotates the bolt 62 through its end socket 64 until the wedge assembly is fully engaged. A similar procedure will take place between the second bearing assembly 25 and the second wedge member 54 at the opposite end of the door 11. The installer will then raise or lower the door 11 relative to the guide paths 23 by appropriately rotating the bolt 62 at each end of the door 11 so that the key 43 reciprocates freely within the guide strips 40 with the mohair brushes 42 suitably brushing the key 43 as the movement of the door 11 takes place and so that the door 11 is suitably level within the upper extrusion 22 and so that the vertical ends 73 of the door 11 match the vertical sides (not shown) of the door frame.

It will be appreciated that the bearings 24 act on either side of the longitudinal axis 70 of the upper support bracket 22 and that the door 11 hangs vertically from the hanger 52 which is connected to the bearings 24. Thus, the weight of the door 11 acts generally vertically downwardly and generates little if any moment on the bearings 24 and bearing assembly 25. The key 43 thereby also moves freely within the guide strips 40 and allows the mohair brushes 40 to brush debris and foreign material off the key 43 which debris is disposed of through the bottom and side drain holes 50, 44, respectively, in the drain tube 33. The key 43 also serves to block the egress of wind and water driven from the outside environment. Any such wind, water or debris will fall into the guide strips 40, thence to the guide tube 33 and out to the outside via drain tubes 44, 50.

The use of the wedge member 54 to move the door 11 upwards and downwards will allow a single installer to provide the finished door installation in which the door 11 may be centered and raised or lowered as necessary so the loading of the door 11 will fall on the bearings 24 of the bearing assembly 25 and so that the door 11 may be appropriated fitted within the door frame to provide a close matching fit with the door frame. The panel or door members 11, 12 may also be easily raised relative to the guide tube 33 by a user using the described tool to rotate bolt 62 and thereby raise the panel members 11, 12 relative to the guide tube 33. If the user intends to clean the guide tube 33 and drain tubes 40 of the sill assembly 21, it is convenient to do so without the necessity of removing the heavy door or panels 11, 12. All the members making up the sill assembly 21 can be easily replaced if necessary.

Many modifications will readily occur to those skilled in the art to which the invention relates. For example, the use of relative movement between the wedge member 54 and the bearing assembly 25 so as to lift and lower the door 11 relative to the extrusion 22 may suitably be modified by allowing the bearing assembly 25 to remain stationary relative to the door 11 and by moving the wedge member 54 relative to the door 11 and bearing assembly 25. All that is needed is relative movement between the bearing assembly 25 and the wedge member 54 in order to provide the necessary adjustment. Likewise, while it is apparent that the use of heavy sliding doors, used in exteriorly exposed position, will most often make use of the invention, it is intended to cover sliding panel members as well.

It is further contemplated that, of course, portions of the sill assembly can be raised if desired such that the sill assembly may project above the surfaces of the exterior and interior floors.

Many further modifications will readily occur to those skilled in the art to which the invention relates and the particular embodiments herein described should be taken as illustrative of the invention only and not as limiting its scope as defined in accordance with the accompanying claims.

We claim:

1. Suspension system and sliding panel assembly comprising at least one vertically positioned sliding panel, said sliding panel having an upper frame and a bottom, a bearing assembly connected to said upper frame of said sliding panel, a bottom guide for said sliding panel connected to said bottom of said sliding panel, said bearing assembly including at least two sets of bearings, each of said sets of bearings comprising a pair of wheels mounted perpedicularly to the plane of said panel and each of said wheels being operable to move in a respective concave track, a hanger connected and centrally hung between each of said pair of wheels, said hanger running parallel to the plane of said sliding panel a distance at least substantially as long as the length between said sets of bearings, said hanger being received within a wedge, said wedge extending for a distance at least as long as said hanger, said wedge being operably mounted between said panel and said bearing assembly, either of said wedge or said bearing assembly being movable relative to the other of said wedge and bearing assembly with said other of said wedge or hanger being stationary relative to said panel and being operably attached to said panel, said sliding panel being hung from said hanger such that the weight of said panel acts principally through said hanger and applies substantially equal loading to each of said pair of wheels, said wheels having rounded convex circumferences which are complementary to and which run within said concave track.

2. Suspension system as in claim 1 wherein said wedge assembly is mounted to said panel and said bearing assembly is mounted for movement relative to said wedge assembly and said panel, said movement of said bearing assembly in a first direction relative to said wedge allowing movement of said panel upwardly and movement of said bearing assembly in said wedge in a second and opposite direction allowing movement of said panel downwardly.

3. Suspension system as in claim 2 and further including a guide channel to allow movement of said bottom guide within said guide channel and brushes within said guide channel to contact said bottom guide.

4. Suspension system as in claim 3 and further comprising openings in said guide channel to allow drainage of water or other contamination received by said guide channel.

5. Suspension system as in claim 1 wherein said sliding panel may be either a door or a solid panel member.

6. A sliding panel and bearing assembly for installation within an upper bracket of a panel frame and a lower drain tube of said panel frame, said sliding panel having a top and a bottom, said sliding panel and bearing assembly comprising an upper bearing connected to said top of said sliding panel and movable within said upper bracket and a lower guide member on said bottom of said panel which guide member is movable within said lower drain tube, said upper bearing comprising at least two sets of bearings, each of said sets of bearings including a pair of rotatable wheels, each of said wheels having a convex circumference which convex circumference is complementary to and moves within respective concave guide paths located on opposite sides of and within said upper bracket and a hanger extending downwardly from said sets of bearings and between said pair of rotatable wheels, said hanger extending on the top of said panel a length at least substantially as long as the distance between said sets of bearings, said panel having a weight which acts principally downwardly through said hanger and which exerts substantially identical forces on each of said wheels on opposite sides of said hanger, a wedge member operably installed between said bearing assembly and said sliding panel, said wedge member being movable relative to one of said bearing assembly and said sliding panel, the other of said bearing assembly and said sliding panel being stationary relative to said wedge member and being operably attached to said panel, said hanger of said bearing assembly being received in said wedge member, said wedge member extending at least as long as said hanger.

7. A sliding panel and bearing assembly as in claim 6 wherein said sliding panel is a sliding door or a solid panel.

8. A sliding panel and bearing assembly as in claim 6 and further comprising a sill construction and wherein said sliding panel has a bottom which includes a guide operably mounted to said bottom of said sliding panel, said guide being movable within a guide box and flexible brushes acting on each side of said guide to stabilize said sliding panel member during said sliding movement, said guide being a vertically oriented and longitudinal member extending a substantial distance along said bottom of said sliding panel and said guide box having drainage passageways to allow drainage of water from said guide box.

* * * * *